US008826555B2

(12) United States Patent
Ruonavaara

(10) Patent No.: US 8,826,555 B2
(45) Date of Patent: Sep. 9, 2014

(54) SELF-SUPPORTING STORY POLE

(75) Inventor: Justin Lyle Ruonavaara, Houghton, MI (US)

(73) Assignee: Justin Lyle Ruonavaara, Houghton, MI (US)

( * ) Notice: Subject to any disclaimer, the term of this patent is extended or adjusted under 35 U.S.C. 154(b) by 115 days.

(21) Appl. No.: 13/270,162

(22) Filed: Oct. 10, 2011

(65) Prior Publication Data

US 2012/0097808 A1 Apr. 26, 2012

Related U.S. Application Data

(60) Provisional application No. 61/406,747, filed on Oct. 26, 2010.

(51) Int. Cl.
*E04G 21/18* (2006.01)

(52) U.S. Cl.
CPC ..... *E04G 21/1808* (2013.01); *E04G 21/1816* (2013.01)
USPC ..... 33/406; 33/404; 33/408

(58) Field of Classification Search
CPC ..... E04G 21/1808; E04G 21/1816; E04G 21/1825; E04G 21/1841
USPC ..... 33/404, 406, 407, 408, 410, 494
See application file for complete search history.

(56) References Cited

U.S. PATENT DOCUMENTS

| | | | | | |
|---|---|---|---|---|---|
| 420,880 | A * | 2/1890 | Lambdin | 33/404 |
| 2,623,289 | A * | 12/1952 | Kampel | 33/406 |
| 3,096,588 | A * | 7/1963 | Cook | 33/406 |
| 3,114,975 | A * | 12/1963 | Jones | 33/406 |
| 3,127,684 | A * | 4/1964 | Ernst | 33/408 |
| 4,338,728 | A * | 7/1982 | Valead | 33/406 |
| 4,443,954 | A * | 4/1984 | Clark | 33/404 |
| 4,631,833 | A * | 12/1986 | Moye | 33/408 |
| 4,970,797 | A * | 11/1990 | Sarasin | 33/494 |
| 5,542,187 | A * | 8/1996 | Oakley | 33/404 |
| 5,915,809 | A * | 6/1999 | Gilliam | 33/518 |
| 7,310,888 | B2 * | 12/2007 | Gilliland | 33/404 |
| 7,624,508 | B2 * | 12/2009 | Beck | 33/408 |
| 7,997,000 | B2 * | 8/2011 | Van Der Meijden et al. | 33/645 |
| 8,079,155 | B2 * | 12/2011 | Dumas | 33/404 |
| 8,141,830 | B1 * | 3/2012 | Hudson | 33/408 |
| 2012/0097808 | A1 * | 4/2012 | Ruonavaara | 248/125.3 |

* cited by examiner

*Primary Examiner* — Yaritza Guadalupe-McCall

(57) ABSTRACT

A self-supporting story pole eliminates the need to build leads with a level and improves on current systems by using a self-supporting base that only needs to be anchored at one point, rather than two, and can preset the block height and plumb of the wall by using the mounting base system. Mounting hardware that slides on the pole is used for string alignment and also for eliminating flex in the pole by means of a follower guide. The system of the present invention is fast to set up and is designed to be away from the corner for the purpose of tooling the joints.

20 Claims, 3 Drawing Sheets

FIG. 2
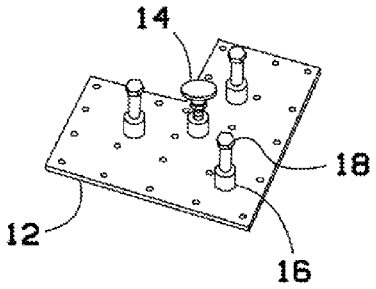
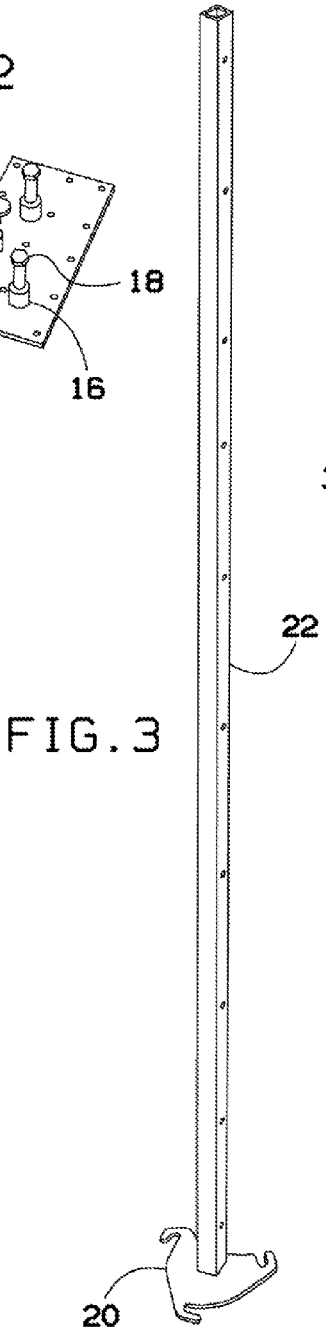
FIG. 3
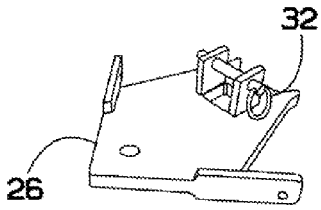
FIG. 4a
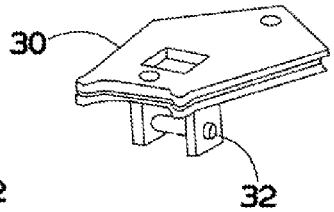
FIG. 4b
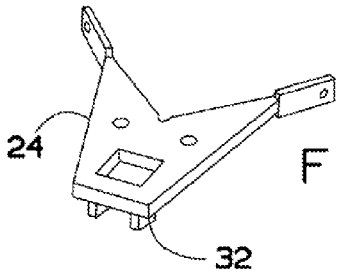
FIG. 4c
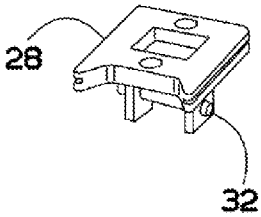
FIG. 4d

SELF-SUPPORTING STORY POLE

CROSS-REFERENCE TO RELATED APPLICATIONS

This application claims the benefit of priority of U.S. provisional patent application No. 61/406,747, filed Oct. 26, 2010, the contents of which are herein incorporated by reference.

BACKGROUND OF THE INVENTION

The present invention relates to masonry tools and, more particularly, to a self-supporting masonry corner story pole that may quickly set height and plumb when laying block or brick.

When masons lay block, it is very time consuming to build leads. A level is used frequently to check level and plumb, which is also time consuming. Conventional story pole systems are difficult to use and take as much time to set up as it does to build the lead with a level. Conventional systems have to be supported by braces or anchored at two points by some means and the block is laid tight to the poles. This requires the pole to be taken down to tool the joints behind the pole before the mortar sets. Moreover, conventional systems may flex from string tension, resulting in a pole that is not plumb.

As can be seen, there is a need for a self-supporting masonry story pole that can quickly set height and plumb when laying block or brick.

SUMMARY OF THE INVENTION

In one aspect of the present invention, a story pole system comprises a base plate adapted to be secured to a footing; a leveling plate adapted to be adjusted to level; a locking plate adapted to attach to the leveling plate; a spacer tube attached to the locking plate; and at least one line block adapted to slide onto the spacer tube, the line blocks adapted to receive a string line.

In another aspect of the present invention, a story pole system comprises a base plate adapted to be secured to a footing; a leveling plate adapted to be adjusted to level; a locking plate adapted to attach to the leveling plate; a spacer tube attached to the locking plate; at least one line block adapted to slide onto the spacer tube, the line blocks adapted to receive a string line; at least one corner follower plate adapted to slide onto the spacer tube; and a plurality of holes disposed along the spacer tube.

These and other features, aspects and advantages of the present invention will become better understood with reference to the following drawings, description and claims.

BRIEF DESCRIPTION OF THE DRAWINGS

FIG. 2 is a perspective view of a base plate of the story pole system of FIG. 1;

FIG. 3 is a perspective view of a spacer tube of the story pole system of FIG. 1;

FIG. 4*a* is a perspective view of an inside corner follower plate of the story pole system of FIG. 1;

FIG. 4*b* is a perspective view of an inside line block of the story pole system of FIG. 1;

FIG. 4*c* is a perspective view of an outside corner follower plate of the story pole system of FIG. 1;

FIG. 4*d* is a perspective view of an outside line block of the story pole system of FIG. 1.

DETAILED DESCRIPTION OF THE INVENTION

Figure 1:
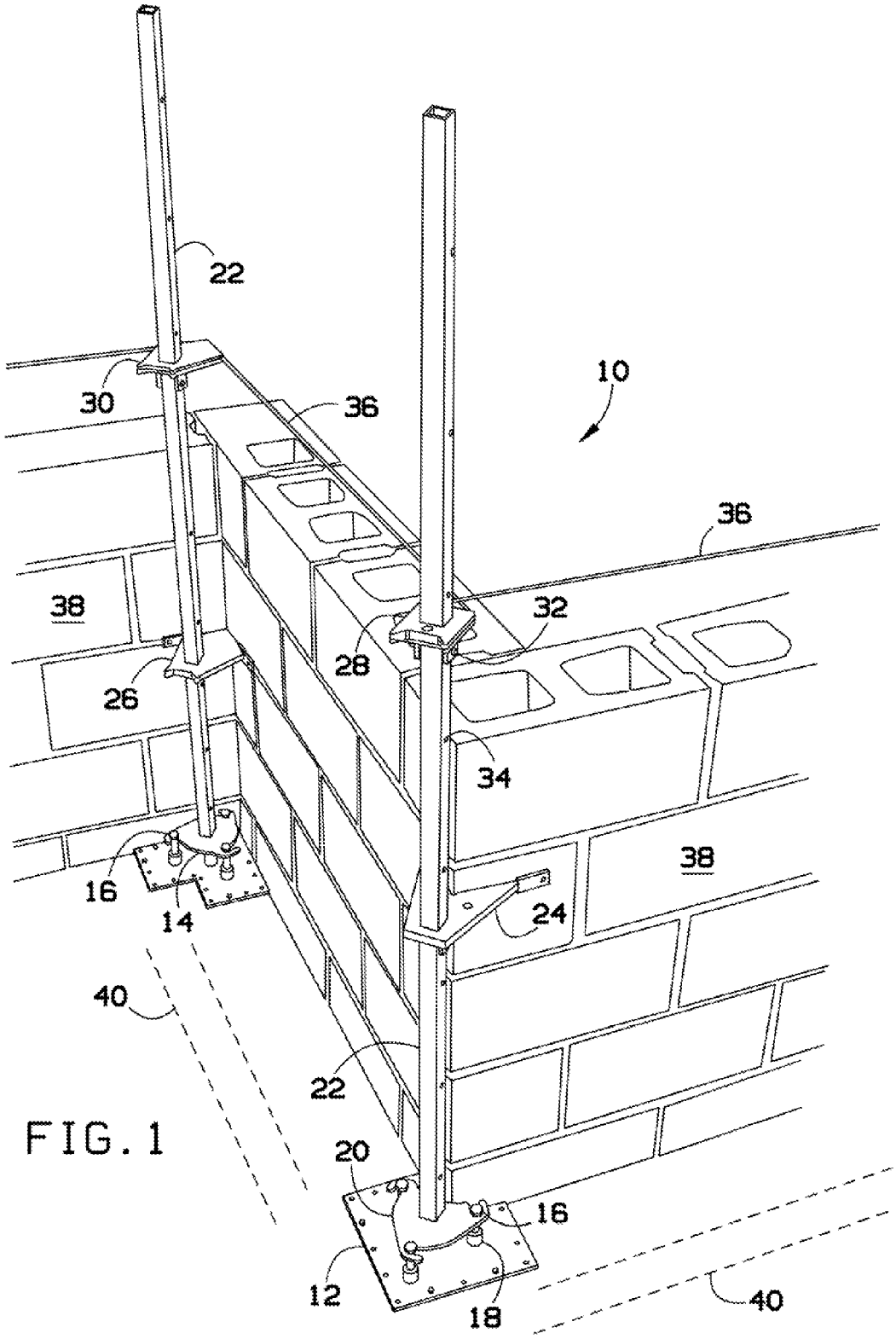
FIG. 1 is a perspective view of a story pole system, in use, according to an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, an embodiment of the present invention provides a self-supporting story pole that eliminates the need to build leads with a level and improves on current systems by using a self-supporting base that only needs to be anchored at one point, rather than two, and can preset the block height and plumb of the wall by using the mounting base system. Mounting hardware that slides on the pole is used for string alignment and also for eliminating flex in the pole by means of a follower guide. The system of the present invention is fast to set up and is designed to be away from the corner for the purpose of tooling the joints.

Referring now to FIGS. 1 through 4*d*, a story pole system 10 may include a flat base plate 12 having multiple holes for securing the base plate 12 to a foundation footing 40. The base plate 12 may be made of a rigid material, such as metal, plastic, composite or the like. A leveling pad 14 may be disposed on the base plate 12 for adjusting the height of a locking plate 20. A plurality of bolts 16 may be used to attach a plurality of bushing mounts 18 to the leveling pad 14.

A spacer tube 22 may be attached to the locking plate 20. The locking plate 20 may include a plurality of slots adapted to fit under the heads of the plurality of bolts 16 attached to the leveling pad 14. The spacer tube 22 may be placed on the bushing mounts 18 and turned about its long axis to lock the locking plate 20 with the bolts 16. The spacer tube 22 may have a plurality of preset holes 34 set at the height and distance of standard masonry blocks. The spacer tube 22 and the locking plate 20 may be formed as a single piece by, for example, welding, and may be made from a rigid material such as stainless steel, aluminum, metal, composite, plastic, or the like.

Figure 5:
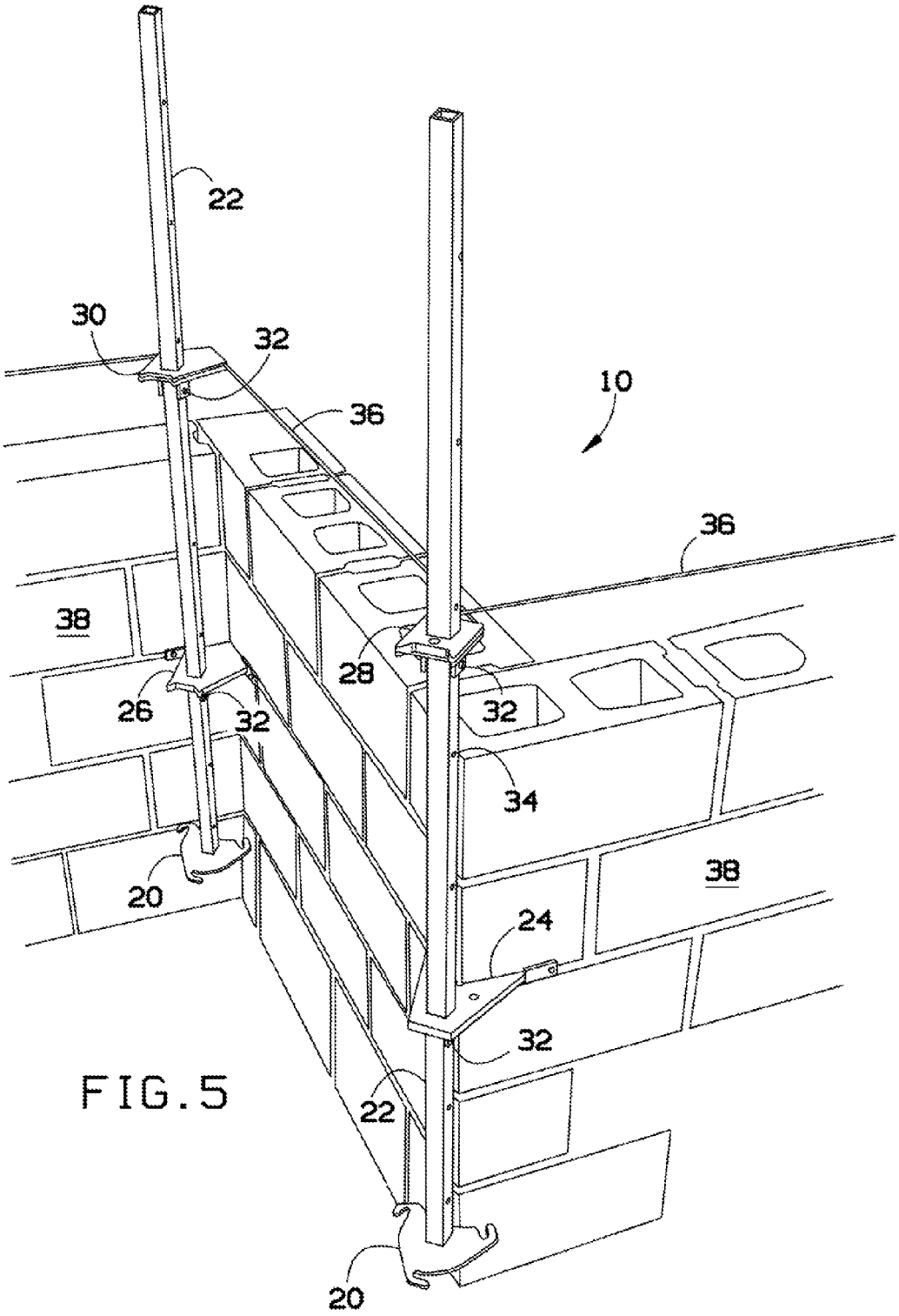
FIG. 5 is a perspective view of the story pole system of FIG. 1 raised for a height adjustment.

An outside corner follower plate 24 or an inside corner follower plate 26 may be slid onto the spacer tube 22. The corner follower plates 24, 26 may be used to stabilize the spacer tube 22 running up the corner of a block wall 38. The corner follower plates 24, 26 may be secured to the wall 38 with bolts or screws. The outside corner follower plate 24 may not require a bolt or screw since a force supplied by a string line 36 (as described below) may retain the outside corner follower plate 24 in position against the block wall 38. The corner follower plates 24, 26 may be made of stainless steel, aluminum, plastic (including ultra-high molecular weight plastic), composite, or the like. The corner follower plates 24, 26 may also be used to secure the locking plate 20/spacer tube 22 to the block wall 38 when more height is needed than the story pole system provides (see FIG. 5). In some embodiments, the spacer tube 22 may be about 8 feet high. A pin 32 may be disposed in the corner follower plates 24, 26. The pin 32 may be inserted into one of the holes 34 to secure the plates 24, 26 to the spacer tube 22 at a desired height.

An outside line block 28 or an inside line block 30 may be slid onto the spacer tube 22. A pin 32 may support the blocks 28, 30 at a desired height along the spacer tube 22. The string line 36 may be run around a groove in the line blocks 28, 30 to interconnect line blocks 28, 30 disposed on adjacent spacer tubes 22. The line blocks 28, 30 can also be used without the pin 32 to be set at other locations on the spacer tube 22. The string line 36 can then be moved via sliding the line blocks 28, 30 up or down the spacer tube 22 so the story pole system can be used for different size blocks other than the standard size masonry block. The line blocks 28, 30 may be made out of metal, such as aluminum or stainless steel, plastic, composite, or the like.

To use the story pole system, a user may first lay wall lines on the footings. The base plate 12 may be lined up at corners of the wall line. The base plate 12 may be adapted to fit both inside and outside corners, as shown in FIG. 1. The base plate 12 may be attached to the footings and the leveling pad 14 may be leveled. The locking plate 20 may be hand-tightened onto the bolts 20 of the leveling pad 14. The corner follower plates (24 or 26, as appropriate) may be placed on the spacer tubes 22 and the plates 24, 26 may be fit into a block set in place at the wall lines. The bolts 16 may then be tightened when the corner follower plates 24, 26 are aligned to the blocks. The line blocks 28, 30 may be placed on the spacer tubes 22 and the string line 36 may be set at a first block height to set the first row of blocks along the string line 36. This process may be repeated for additional layers of blocks. Once a plurality of layers of blocks, for example, three layers of blocks, are in place, the corner follower blocks 24, 26 may be attached to the blocks to help prevent the spacer tubes 22 from flexing.

It should be understood, of course, that the foregoing relates to exemplary embodiments of the invention and that modifications may be made without departing from the spirit and scope of the invention as set forth in the following claims.

What is claimed is:

1. A story-pole system for use in building a wall, the story pole system compromising:

a base plate configured to be secured to a footing;

a plurality of threaded bushings extended from the base plate;

a leveling pad configured to be attached to at least one of the treaded bushings and adjusted to level;

a locking plate configured to attach to the base plate;

a spacer tube further including a plurality of spaced apart holes disposed there along;

wherein the spacer tube is attached to the locking plate;

at least one line block configured to slide onto the spacer tube, the at least one line block configured to receive a string line;

at least one corner follower plate configured to slide onto the spacer tube; and at least one pin configured to fit into at least one of the plurality of spaced apart holes of the spacer tube to secure at least one of the line block or the corner follower plate at a predetermined height.

2. The story pole system of claim 1, wherein the leveling pad is configured to be attached to at least one of the threaded bushings via a threaded adjustment to adjust the height of the leveling pad relative to the base plate.

3. The story pole system of claim 2, comprising threaded bolts for engagement with the plurality of threaded bushings, wherein the locking plate is configured to be secured to the base plate whereby the locking plate is adjustably supported and secured at the leveling pad when the bolts are tightened.

4. The story pole system of claim 3, wherein the locking plate includes a plurality of slots for engagement with the threaded bolts, and wherein the locking plate is rotatable about its longitudinal axis for engagement or disengagement with the bolts when the bolts are loosened.

5. The story pole system of claim 2, wherein an upper surface of the leveling pad contacts a lower surface of the locking plate.

6. The story pole system of claim 2, wherein the at least one corner follower plate comprises on of (i) an inside corner following plate configured for use at an inside of a corner of the wall and (ii) an outside corner following plate configured for use at an outside of a corner of the wall.

7. A story pole system for use in building a wall, the story pole system comprising:

a base plate configured to be secured to a footing;

a leveling plate configured to be adjusted to level;

a plurality of bushings extending from the leveling plate;

a locking plate configured to attach to the leveling plate;

a plurality of fasteners, wherein the locking plate is configured to be secured to the bushings of the leveling plate with fasteners;

a spacer tube attached to the locking plate; and at least one line block configured to slide onto the spacer tube, the at least one line block configured to receive a string line.

8. The story pole system of claim 7, comprising at least one corner follower plate configured to slide onto the spacer tube.

9. The story pole system of claim 8, wherein the at least one corner follower plate has holes for attaching the corner follower plate to a block wall.

10. The story pole system of claim 7, comprising a plurality of holes disposed along the spacer tube.

11. The story pole system of claim 10, comprising a pin disposed at the at least one line block and configured to engage one of the plurality of holes in the spacer tube to secure the at least one line block at a selected height.

12. The story pole system of claim 7, wherein the bushings comprise threaded bushings and wherein the fasteners comprise threaded bolts that threadedly engage the threaded bushings.

13. The story pole system of claim 7, wherein the locking plate includes a plurality of slots for engagement with the fasteners, and wherein the locking plate is rotatable about its longitudinal axis for engagement and disengagement with the fasteners when the fasteners are loosened.

14. The story pole system of claim 7, wherein an upper surface of the leveling plate contacts a lower surface of the locking plate.

15. A story pole system for use in building a wall, the story pole system comprising:

a base plate configured to be secured to a footing;

a leveling plate configured to be adjusted to level;

a plurality of treaded bushings extending from the leveling plate;

a locking plate configured to attach to the leveling plate;

a plurality of threaded fasteners that threadedly engage the treadeded bushings, wherein the locking plate is configured to be secured to the leveling plate with the threaded fasteners;

a spacer tube attached to the locking plate;

at least one corner follower plate configured to slide onto the spacer tube; and a plurality of holes disposed along the spacer tube.

16. The story pole system of claim 15, comprising at least one pin disposed at the at least one corner follower plate, wherein the pin is configured to engage one of the plurality of holes in the spacer tube to retain the at least one corner follower plate at a selected position along the spacer tube.

17. The story pole system of claim 15, comprising at least one line block configured to slide onto the spacer tube, the line blocks configured to receive a string line.

18. The story pole system of claim 15, wherein the at least one corner follower plate comprises one of (i) an inside corner following plate configured for use at an inside of a corner of the wall and (ii) an outside corner following plate configured for use at an outside of a corner of the wall.

19. The story pole system of claim 15, wherein the locking plate includes a plurality of slots for engagement with the threaded fasteners, wherein the locking plate is rotatable about its longitudinal axis for engagement and disengagement the threaded fasteners when the threaded fasteners are loosened.

20. The story pole system of claim 15, wherein an upper surface of the leveling plate contacts a lower surface of the locking plate.

* * * * *